US006145694A

United States Patent [19]

Roesing

[11] Patent Number: 6,145,694

[45] Date of Patent: Nov. 14, 2000

[54] PLUG-TYPE BARREL

[75] Inventor: Karl-Heinz Roesing, Blankenheim, Germany

[73] Assignee: Krupp Kautex Maschinenbau GmbH, Bonn, Germany

[21] Appl. No.: 09/482,427

[22] Filed: Jan. 13, 2000

[30] Foreign Application Priority Data

Feb. 10, 1999 [DE] Germany ..... 199 05 898

[51] Int. Cl.[7] ..... B65D 6/40

[52] U.S. Cl. ..... 220/601

[58] Field of Search ..... 220/601, 661, 220/465, DIG. 1, DIG. 6

[56] References Cited

U.S. PATENT DOCUMENTS

| | | | |
|---|---|---|---|
| 4,736,862 | 4/1988 | Hammes et al. | 220/601 |
| 4,776,479 | 10/1988 | Schütz . | |
| 4,898,296 | 2/1990 | Burgdorf . | |
| 4,941,584 | 7/1990 | Bowers et al. | 220/601 |
| 5,014,873 | 5/1991 | Clemens et al. . | |
| 5,044,510 | 9/1991 | Schütz . | |
| 5,217,142 | 6/1993 | Schütz . | |
| 5,273,181 | 12/1993 | Gay | 220/601 |
| 5,593,060 | 1/1997 | Przytulla | 220/601 |
| 5,975,338 | 11/1999 | Przytulla et al. . | |

FOREIGN PATENT DOCUMENTS

| | | |
|---|---|---|
| 0 287 966 A2 | 10/1988 | European Pat. Off. . |
| 0 291 695 A2 | 11/1988 | European Pat. Off. . |
| 0 366 129 A1 | 5/1990 | European Pat. Off. . |

*Primary Examiner*—Joseph M. Moy
*Attorney, Agent, or Firm*—Akin, Gump, Strauss, Hauer & Feld, L.L.P.

[57] ABSTRACT

A barrel of thermoplastic material has a peripherally extending carrier and transportation ring in the region of its upper end portion and at least one plughole connection in the edge region of the latter. The bung hole connection is disposed within a housing which is let into the upper end portion. The housing is open at its side towards the edge of the barrel while at its other side it has a boundary end wall, from each of the two ends of which a respective wall extends towards the edge of the barrel, the walls laterally defining the housing. The walls defining the housing are delimited at the top side by a transition from the respective wall into the upper end portion of the barrel and at the lower end by a transition from the respective wall into the bottom of the housing. The spacing between the upper transitions of the two ends of the housing is greater than the spacing between the two lower transitions and the upper transitions diverge towards the edge of the barrel. The transitions between the side walls and the upper end portion of the barrel body on the one hand and the transitions between the side walls and the bottom of the housing on the other hand do not extend parallel. The transitions between the side walls and the upper end portion include an angle which is at least 120°.

11 Claims, 5 Drawing Sheets

PLUG-TYPE BARREL

FIELD OF THE INVENTION

The invention concerns a plug-type barrel.

In this specification the term barrel is used in a broad sense to denote a container in the form of a barrel or drum, more specifically such a container having a body portion and end portions at each end thereof, which are fixed to the body portion. The term plug is used to denote a stopper or like closure member which is fitted into a plughole in at least one end portion of the barrel.

BACKGROUND OF THE INVENTION

A typical form of plug-type barrel of thermoplastic material includes a carrier and transportation ring extending around the main body portion of the barrel in the region of the upper end portion thereof. The barrel has at least one plughole connection, for example in the form of a raised rim portion, which is disposed in the edge region of the upper end portion of the barrel and which is disposed within a housing configuration which is let into the upper end portion of the barrel. At its side towards the edge of the barrel the housing is open while at its opposite side it has a boundary wall, from both ends of which extends a respective wall laterally defining the housing, towards the edge of the barrel. The walls defining the housing are delimited at the top side by a transition from the respective wall of the housing into the upper end portion and at the lower side by a transition from the respective wall of the housing into the bottom of that housing. The spacing between the upper transitions of the two side walls of the housing is greater than the spacing between the two lower transitions and the upper transitions diverge in a direction towards the edge of the barrel.

In a barrel of that kind, as is to be found in EP 0 291 695 A2, the arrangement is such that the plughole connection at least partially projects into the interior of the barrel and, at its part which is in the interior of the barrel, it is provided with at least one aperture in order to permit the barrel to be extensively emptied. A disadvantage of that design configuration is that the plughole connection has to be produced separately and mounted to the body of the barrel in a separate working operation. This means that it is not possible to enjoy the advantages of a blow molding procedure which in many cases is used for the production of barrels of plastic material and which permits the barrel to be produced in one piece in a single working operation.

SUMMARY OF THE INVENTION

An object of the present invention is to provide a plug-type barrel of thermoplastic material which enjoys improved properties and capabilities in terms of emptying residual contents therefrom while also being easy to manufacture.

Another object of the invention is to provide a barrel of thermoplastic material which can be readily produced in one piece as by a blow molding procedure in spite of incorporating structural features such as to enhance discharging contents at least almost entirely from the barrel.

In accordance with the principles of the invention the foregoing and other objects are attained by a barrel comprising a body portion with first and second end portions at respective ends thereof. A carrier and transportation region extends on the body portion around same at least adjacent to the first end portion on the body portion. At least one plughole connection is arranged in an edge region of the first end portion, being disposed within a housing provided in the first end portion and being open at a side thereof which is towards the edge region of the first end portion. At its opposite side the housing has a boundary side wall, from each of the two ends of which a wall laterally defining the housing extends towards the edge of the first end portion. The walls defining the housing are delimited at the top by a transition from the respective housing wall into the first end portion and at the bottom by a transition from the respective housing wall into the bottom surface of the housing. The spacing between the upper transitions of the two side walls of the housing is greater than the spacing between the two lower transitions, with the upper transitions diverging towards the edge of the first end portion. The transitions between the housing side walls and the first end portion on the one hand and the transitions between the housing side walls and the housing bottom surface on the other hand extend in mutually non-parallel relationship, with the transitions between the housing side walls and the first end portion including an angle of at least 120°.

By virtue of that configuration, as will be seen in greater detail from the description hereinafter of a preferred embodiment of the invention, the two transitions which respectively delimit each side wall of the housing at top and bottom thereof diverge from the end boundary wall thereof towards the edge region of the barrel, such that the inclination of each side wall decreases from the end wall of the housing towards the edge region of the barrel.

It will be noted at this point that a plug-type barrel is to be found in EP 0 515 390 B1, in which the upper end portion, in addition to or beside the housing configuration in which the plughole connection is disposed, has a bevel portion or surface portion which is substantially in the form of a part of a circle, wherein the bevel portion has its lowest point on the side of the peripheral part of the barrel, in the region of the seam of the plughole connection. It will be appreciated however that a consequence of that design configuration is that the region of the upper end portion of that barrel involves a comparatively large number of curved and angled wall regions which in part extend approximately at a right angle to each other and provide for stiffening the upper end portion of the barrel. In the event of the upper end portion being subjected to loadings by thrust and impact forces, that design configuration can result in uncontrollable stresses and unacceptable loadings in the plastic material forming the barrel. It will be seen therefore that use of the invention affords a simpler design configuration as the first end portion, besides the housing for containing the plughole therein, does not require any further bevel configurations and surface portions in the form of a part of a circle in order to achieve the desired effect.

As will be seen more clearly hereinafter, it is in fact the lateral boundary walls defining the housing configuration in which the plughole connection is disposed, which by virtue of their configuration according to the invention, also at the same time permit very substantial emptying of the entire contents of the barrel, when the barrel is in the emptying position. In general terms, with an increasing angle formed by the two side walls of the housing configuration containing the plughole connection, increasing residual emptying will be achieved. As on the other hand, with an increasing value of that angle, the remaining surface area at the end portion of the barrel in which the plughole connection is disposed, which is used as a stacking surface for the barrel, decreases, it will in practice be important to arrive at an optimum in terms of those two requirements. This is readily possible as for example with a value of that angle of 140° between the two side walls at the transition thereof to the first end portion of the barrel, it will generally be possible to achieve a degree of emptying of the residual contents of the barrel, that is sufficient for all practical requirements, while at the same time the surface area available for securely stacking the barrel is sufficiently large.

It may be noted here that a further advantage of a barrel in accordance with the invention is that, as the side walls of the housing extend more shallowly than in prior-art configurations, it is an easier matter to shape the barrel in a blow molding procedure. That is an aspect of significance in particular for the reason that normally the separating surface of the blow molding mold which is generally of a two-part nature passes through the plughole connection and thus through the housing accommodating same in the first end portion of the barrel, with the consequence that the preform from which the barrel is then produced by the application of an increased pressure in the interior thereof is gripped between the two mold portions precisely near to the region, along that separating surface, in which the preform has to be deformed in order to form heavily angled and curved wall regions, for example in the area of the housing accommodating the plughole connection. By virtue of the configuration of the housing of the barrel according to the invention, that barrel reduces the problems and difficulties which are incurred in that respect. Removal of the barrel according to the invention from the mold is also a noticeably simpler procedure by virtue of the barrel configuration in the region of the housing in its first end portion.

In accordance with a preferred feature of the invention, while the transitions between the side walls of the housing and the bottom thereof may extend in substantially mutually parallel relationship, it may also be desirable to those transitions to be caused to converge somewhat from the boundary end wall of the housing towards the edge of the barrel, with the result that the bottom of the housing decreases in size somewhat towards the edge of the barrel and thus the two transitions are also still closer to the plughole, whereby the residual emptying effect is still further improved.

Further objects, features and advantages of the invention will be apparent from the description hereinafter of a preferred embodiment.

DESCRIPTION OF THE PREFERRED EMBODIMENT

Figure 1:
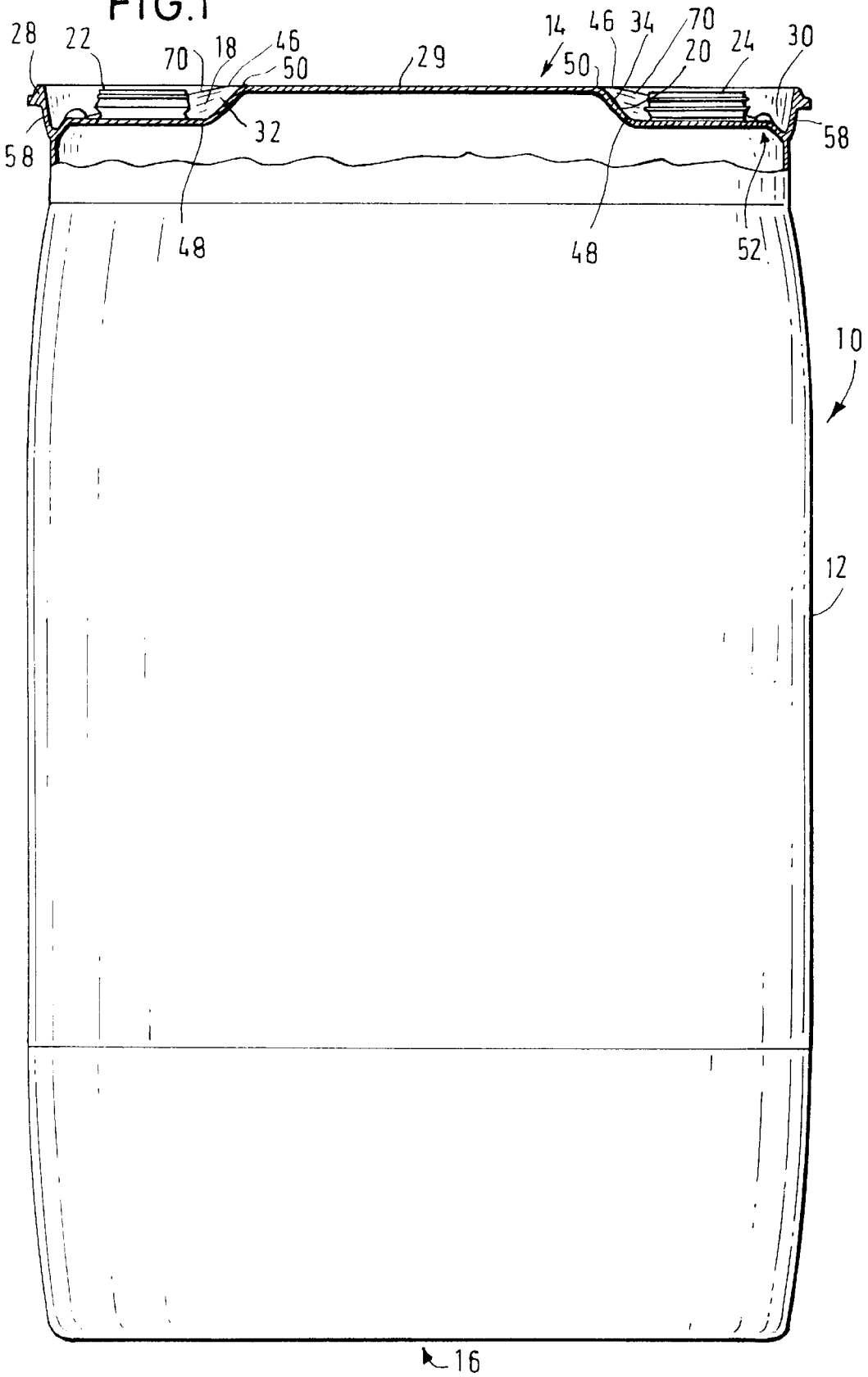
FIG. 1 shows a side view of a barrel according to the invention having two plughole connections, both of the housings of which are better adapted for residual emptying of the barrel.

Referring generally to the drawing, the embodiment of a stackable plug-type barrel 10 in accordance with the invention as illustrated therein has a barrel body portion generally indicated at 12, a first end portion 14 which in the position of the barrel illustrated is the upper end portion and a second end portion 16 which in the illustrated position is the lower end portion. The first end portion 14 is provided with two generally trough-shaped depressions which each form a respective housing indicated generally at 18 and 20 for a connection or rim-like portion 22 and 24 respectively. Each connection 22, 24 defines a respective opening indicated at 25 and 26 in FIG. 2. The barrel 10 is provided towards its upper end, in the region of the first end portion 14, with a peripherally extending carrier and transportation ring 28 carried by a peripherally extending collar 58. The latter, with the first end portion 14, defines a groove 30 which is open upwardly in the FIG. 1 position.

Usually only one of the two openings 25, 26 of the barrel serves for emptying residues therefrom while the other opening is used for normal emptying of the barrel, for example using a tube which is connected to a pump and which is introduced into the interior of the barrel through the appropriate opening. The housing which is associated with the connection of that opening can therefore also be of the usual configuration, that is to say narrower, in order to afford a stacking surface area which is as large as possible for stacking the barrel. The barrel as illustrated in the drawing is provided with two openings for residue emptying and thus illustrates possible different configurations of the respective housings 18, 20.

The depth of the two housings 18, 20 is such that the respective connection 22, 24 does not project upwardly beyond the upper boundary surface 29 of the end portion 14 of the barrel 10, the surface 29 serving at the same time as the surface for stacking of the barrel.

Each of the two housings 18, 20 which are arranged in the edge region of the end portion 14 of the barrel is open at its side which is towards the edge of the barrel or the ring 28. At the opposite side of the connection 22, 24, which respectively faces away from the ring 28, the respective housing is delimited by an end wall 32 and 34 respectively which extends inclinedly between the bottom of the housing as indicated at 36, 38 for example in FIG. 2 while also being indicated at 36 in FIG. 3, and the end portion 14. The drawing and more particularly FIG. 2 thereof shows transitions 48, 50 between the respective end walls 32, 34 on the one hand and the bottom of the housing 18, 20 and the end portion 14, the transitions being shown in each case as edges. In actual fact however the transitions will generally be of a rounded-off configuration, as is entirely usual when molding plastic materials, in particular when using a blow molding procedure.

Figure 2:
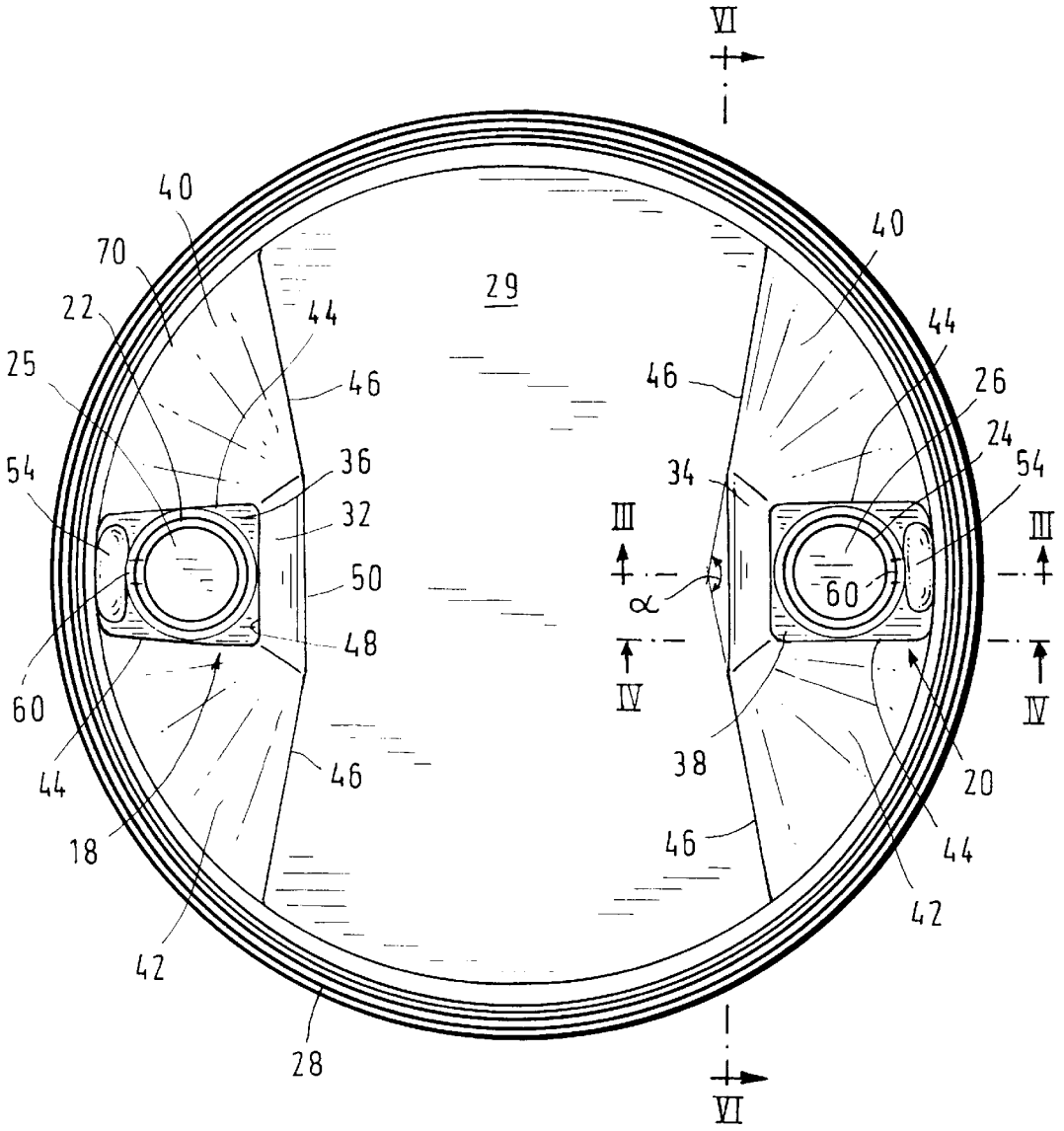
FIG. 2 is a plan view of the FIG. 1 barrel, with the two housings being of respectively different configurations.
Figure 4:
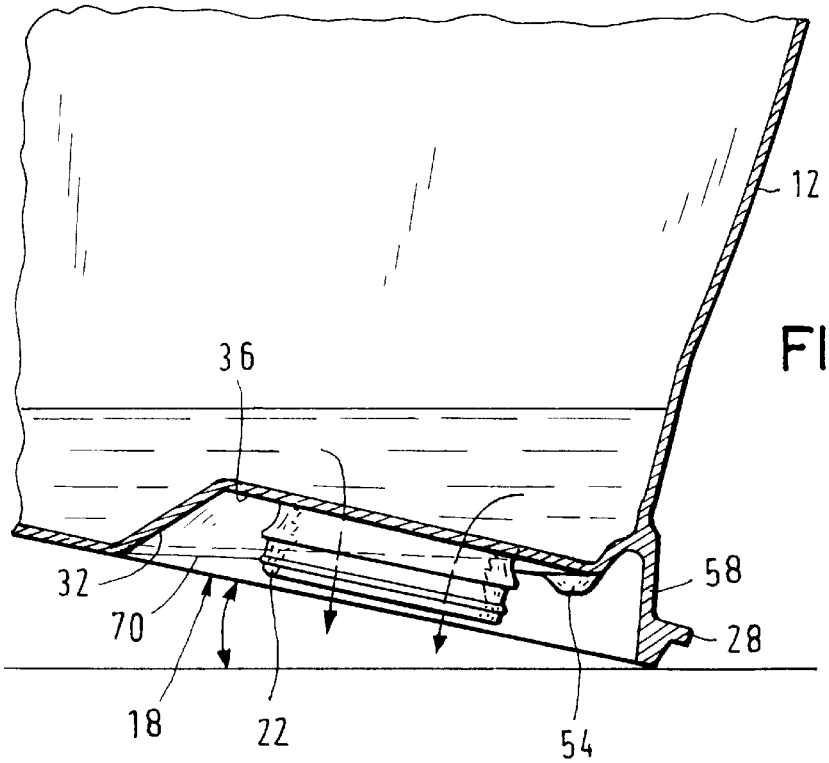
FIG. 4 is a view in section taken along line IV—IV in FIG. 2.

Both ends of the respective boundary walls 32 and 34 of the housings are adjoined by a respective side boundary wall 40, 42 which extends also between the bottom 36, 38 of the respective housing 18, 20 and the end portion 14 of the barrel. In this case also there are rounded transitions 44 between the housing bottom 36, 38 and the respective side wall 40, 42 and between the respective wall and the end portion 14. These latter transitions are identified by reference numeral 46 for example in FIG. 2. Unlike the transitions 48, 50 which delimit the end walls 32, 34 and which extend substantially parallel, the transitions 44 and 46 are arranged in diverging relationship in such a way that, starting from the respectively associated end wall 32, 34, the spacing between the transitions 44, 46 increases towards the carrier ring 28 and thus the edge of the barrel. FIG. 2 in particular shows that the transitions 44, 46 which delimit the side walls 40, 42 at top and bottom diverge very greatly so that the side walls form inclined surfaces, the inclination or gradient of which decreases from the respectively associated end wall 32 and 34 in a direction towards the ring 28. That configuration thus provides inclined surfaces which extend in a direction towards the edge of the barrel and the respective opening 26, 28 and which, as FIG. 5 in particular shows, pass the liquid in the barrel towards the respective opening 26 or 28 when the barrel is in the position for emptying thereof as shown in FIGS. 3 and 4.

The two transitions 44 between the side walls 40, 42 of each housing 18, 20 and the respective housing bottom 36 and 38 extend closely beside the respective connection 22, 24 so that, if the upper transitions 46 include an angle α of for example 140°, each side wall 40, 42 involves an extent of about 70° in terms of angle measurement between the lower transition 44 and the upper transition 46. The angle may be at least 120°, preferably not less than 140°, for example about 160°. The respective angular measurement thus corresponds to the length of the transition 70 between the side wall 40, 42 on the one hand and the surfaces defining the groove 30 on the other hand. As the length of the transition 70 also determines the fall, in regard to emptying of the barrel in a given position thereof, the fall can consequently also be determined by way of the choice of the magnitude of the angle α. An angle α of more than 180°0 will normally not be considered if the barrel is to be stackable as then the surface area available for stacking would be excessively greatly reduced and there would be the danger that the connection would then have to perform a load-bearing function in that situation.

Looking now at FIG. 2, in the case of the housing 20 shown at the right therein the two transitions 40, from the end wall 34, extend substantially parallel to the edge of the barrel at which the housing which is delimited only at three sides by the walls is open. This latter aspect also applies in regard to the housing indicated at 18 on the left in FIG. 2, but the lower transitions 44 of the side walls thereof, starting from the associated end wall 32, converge somewhat in a direction towards the peripheral edge of the barrel, whereby the filling material which is capable of flow is brought still closer to the outlet or drain opening 26, by the inclined lateral walls 42, 44.

Figure 3:
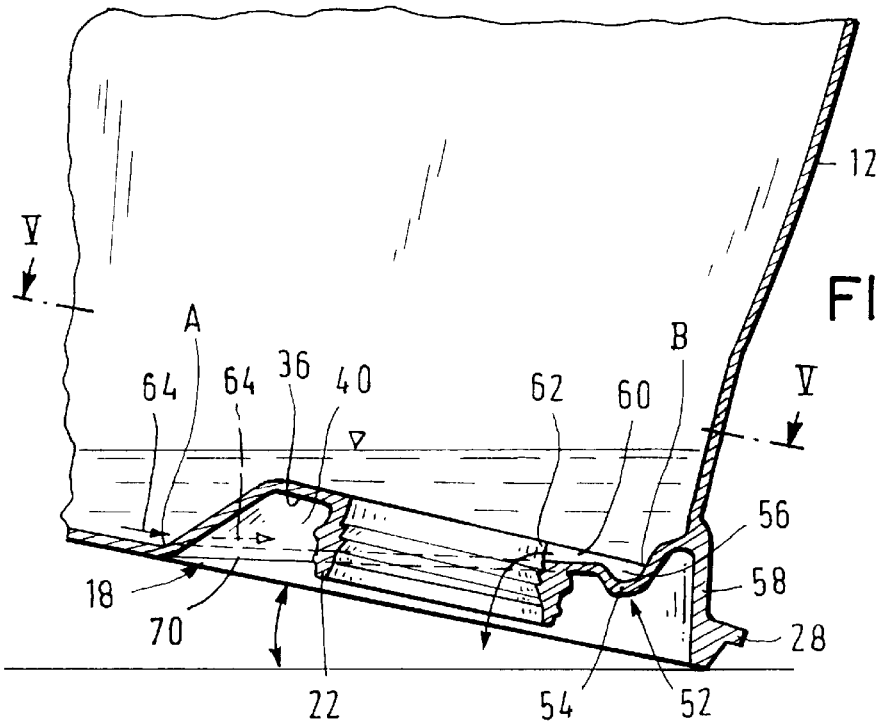
FIG. 3 is a view in section taken along line III—III in FIG. 2.

FIG. 3 in particular shows that the bottom 36 of the housing 18 is provided in the region between the connection 22 and the peripheral edge of the barrel with a fold as indicated at 52 and which forms a bead or ridge 54. When the barrel is in the position shown in FIG. 1, the bead or ridge 54 projects upwardly out of the bottom 36 of the associated housing. A recess 56 corresponding to the bead or ridge 54 is thus also formed at the inside of the housing bottom 36. The fold 52 forms a deformation zone between the edge of the barrel or the annular collar 58 on the one hand and the respective connection 22 or 24 on the other hand. That deformation zone serves to absorb forces acting on the edge of the barrel in a direction towards the respective connection 22 or 24, at least to such an extent that no unacceptable loadings occur in the region of the connection. Admittedly, that effect is achieved by temporary deformation of the fold 52, but that is not a material consideration as the fold returns to its original condition again when the impact or shock loading is terminated.

Figure 5:
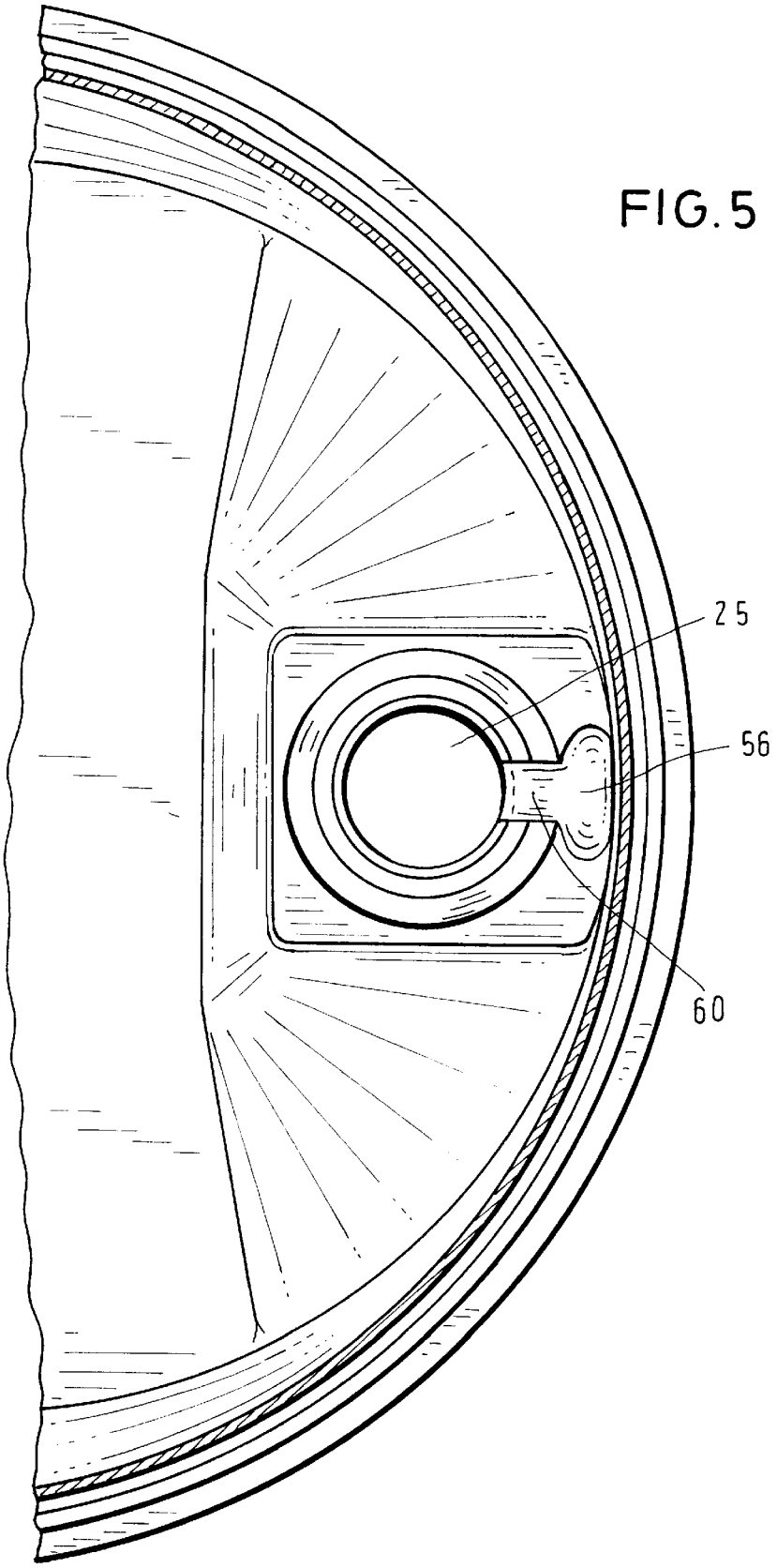
FIG. 5 is a view in section taken along line V—V in FIG. 3.
Figure 6:
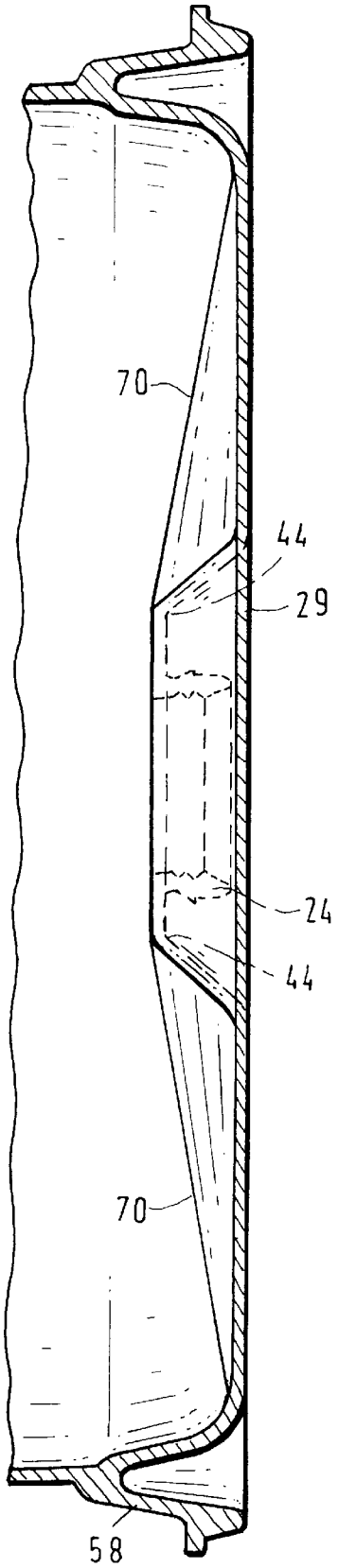
FIG. 6 is a view in section taken along line VI—VI in FIG. 2.

The barrel 10 is also provided at its inside with a substantially radially extending channel-shaped depression 60, as shown in FIGS. 3 and 5, which extends from the recess 56 produced by the fold 52 approximately radially through the region of the connection 22 or 24, which is the lower region in the normal position of the barrel, as shown in FIG. 1, into the opening 25 or 26 respectively defined by the corresponding connection. For that purpose, at its edge region which is the lower edge region in the normal position of the barrel as shown in FIG. 1, the connection 22 or 24 is provided with an aperture indicated at 62 in FIG. 3. The channel 60 is intended to permit the barrel to be emptied to a still further degree, so that even remains of the barrel contents which are in the region between the respective connection 22 or 24 and the edge of the barrel can flow out of the barrel, possibly with the assistance of suitable pivoting or tilting movement of the barrel.

FIG. 3 shows that, during the operation for emptying the remains of the contents of the barrel from the latter, the barrel contents flow for example from the region A by way of the lateral, preferably flat walls 40, 42 in the direction indicated by the arrows 64 into a region B between the respective connection 20 or 22 and the edge of the barrel and from there in particular through the channel-shaped depression 60 into the respective connection and are discharged through same from the barrel.

The above-described configuration in accordance with the invention provides that the side walls of the housing in the end portion of the barrel additionally perform the function in emptying of the barrel of guiding the content thereof towards the emptying opening.

It will be appreciated that the above-described embodiment of the invention has been set forth by way of example and illustration of the principles thereof and that various modifications and alterations may be made therein without thereby departing from the spirit and scope of the invention.

What is claimed is:

1. A plug-type barrel comprising a body portion having first and second ends, a first and second end portion at respective ends of the body portion, at least one housing let in the first end portion, said housing having a bottom, a first side of the housing which is open towards an edge region of the first end portion and a second side opposite said first side having a boundary end wall, from each of the two ends of which a respective side wall laterally defining the housing extends towards the edge of the first end portion, wherein the walls defining said housing are delimited at the top by a transition from the respective wall of the housing into the first end portion and at the bottom by a transition from the respective wall of the housing into the bottom of the housing, and the spacing between the upper transitions of the two side walls of the housing is greater than the spacing between the two lower transitions and the upper transitions diverge towards the edge of said first end portion, the transitions between the side walls and the first end portion on the one hand and the transitions between the side walls and the bottom of the housing on the other hand extending in mutually non-parallel relationship and the transitions between the side walls and the first end portion including an angle of at least 120°, and at least one plughole connection arranged in an edge region of the first end portion and disposed within said at least one housing.

2. A barrel as set forth in claim 1 and further including a carrier and transportation ring on the body portion extending therearound in the region of the first end portion.

3. A barrel as set forth in claim 1 wherein said transitions between said side walls and the bottom of said housing extend in substantially mutually parallel relationship.

4. A barrel as set forth in claim 1 wherein the transitions between said side walls and the bottom of the housing converge from said boundary end wall towards the edge of the first end portion.

5. A barrel as set forth in claim 1 wherein the transitions between said side walls and the bottom of said housing diverge from the boundary end wall in a direction towards the edge of said first end portion, the extent of such divergence being less than the divergence of the transitions between said side walls and the first end portion.

6. A barrel as set forth in claim 1 wherein said angle is at least 140°.

7. A barrel as set forth in claim 1 wherein said angle is about 160°.

8. A barrel as set forth in claim 1 and further including between said plughole connection and the edge of said first end portion a deformation zone which has at least one fold means extending substantially parallel to the edge of said first end portion.

9. A barrel as set forth in claim 1 and further including between said plughole connection and the edge of said first end portion a deformation zone which has at least one fold means extending substantially tangentially to the edge of said first end portion.

10. A barrel as set forth in claim 8 and further including a channel depression between said plughole connection and said fold means on the inside of said barrel.

11. A barrel as set forth in claim 9 and further including a channel depression between said plughole connection and said fold means on the inside of said barrel.

* * * * *